US007497742B2

(12) United States Patent
Spinnato

(10) Patent No.: US 7,497,742 B2
(45) Date of Patent: Mar. 3, 2009

(54) ONE-PIECE, CONTROLLED INSERTION FORCE, ELASTIC SOCKET TYPE CONTACT

(75) Inventor: Gilbert Spinnato, Bois d'Arcy (FR)

(73) Assignee: Souriau, Versailles (FR)

( * ) Notice: Subject to any disclaimer, the term of this patent is extended or adjusted under 35 U.S.C. 154(b) by 0 days.

(21) Appl. No.: 11/760,922

(22) Filed: Jun. 11, 2007

(65) Prior Publication Data

US 2007/0287319 A1 Dec. 13, 2007

(51) Int. Cl.
*H01R 11/22* (2006.01)

(52) U.S. Cl. ..... 439/851

(58) Field of Classification Search ..... 439/851, 439/843, 852, 853, 854, 856, 857
See application file for complete search history.

(56) References Cited

U.S. PATENT DOCUMENTS 5,067,916 A 11/1991 Denlinger et al.
2002/0055305 A1* 5/2002 Williams ..... 439/851

FOREIGN PATENT DOCUMENTS

| | | | |
|---|---|---|---|
| FR | 2450510 | A1 | 9/1980 |
| FR | 2681733 | B1 | 12/1993 |
| FR | 2685558 | B1 | 6/1995 |
| GB | 2274749 | A | 8/1994 |
| WO | 9815036 | | 4/1998 |

* cited by examiner

*Primary Examiner*—Ross N Gushi
(74) *Attorney, Agent, or Firm*—Perman & Green, LLP

(57) ABSTRACT

A one-piece, controlled insertion force, elastic socket type contact 7 for electrical connectors, including a rear part 11 in the form of a rod defining a first cylindrical zone A and a tubular front part 12 including a second cylindrical zone C extending the rear part open in the forward direction and divided up by slots 13 into elastic beams 14, a spindle-shaped end zone D in which the thickness of the beams 14 gradually decreases in the direction of the open end 15 of the tubular part 12 which further includes a cylindrical segment B divided up by slots 13 into at least two elastic beams 14 which has a cone frustum-shaped zone on its outer surface 16.

9 Claims, 3 Drawing Sheets

ONE-PIECE, CONTROLLED INSERTION FORCE, ELASTIC SOCKET TYPE CONTACT

The disclosed embodiments concern one-piece elastic socket type contacts, intended to equip low insertion force electrical connectors.

It concerns more particularly female contacts called elastic, or split, sockets which equip a connector and comprise two or more elastic beams intended to apply by means of a radial movement, a contact pressure needed to provide electrical continuity on the male contacts of the pin type, which equip a complementary mating connector.

In the case of electrical connectors equipped with a large number of female contacts of the split socket type, it is necessary to spread out a large assembly-related effort to make the male contact pin slide into the socket once the latter shall have passed the peak of introduction due to the insertion of the pin onto the open end of the socket. This effort which is also called rating, often involves exceeding the elastic limit of the material of which the socket beams are made, causing a very large dispersion of contact pressure and resulting in a limited number of manoeuvres and a possible loss of electrical continuity, aggravated by the stress corrosion, which develops between the socket and the pin.

In order to reduce the assembly-related effort which compels the user to apply a large force to one of the complementary mating connectors, it is proposed to reduce the inertia of one of the socket beams.

In fact, classical sockets use beams, whose inertia is constant over the length of the beam, involving the development of maximum stress in a single zone of the beam.

These local stress are the cause of exceeding the elastic limit of the material of the beam and of exceeding the elastic limit of the materials present at the point of contact, such as, for example, gold plating applied on the surface of brass, which is the base material of the beam (a phenomenon known as Hertz pressure).

In order to avoid the magnitude of these phenomena resulting from constant inertia over the length of the beam, numerous embodiments have been proposed to date.

Among these embodiments was investigated the use of an elastic contact or pallet supported in a rigid tubular socket and moving elastically in a radial direction under the propulsion of the pin when the complementary mating connectors are being mated.

Patent FR 2 681 733 describes an embodiment of this type, making possible a low insertion force which functions satisfactorily for large contacts, because in the case of small dimensions the use of numerous parts increases the time of manufacturing and of course also cost.

Patent FR 2 685 558 describes an improved embodiment in which there are, for example, three pallets, which come in contact of the pin of the complementary mating connector according to three generatrix.

The embodiments described in these two patents propose a very low rating and provide a solution for the local reduction of the inertia of the beam, because they disclose embodiments in which the inertia variation over the length of the beam is implemented as a result of local reductions of the width of the said beam, whilst the thickness of the material of the beam remains constant.

Improvements have likewise been proposed for classical one-piece sockets, in order to facilitate the connection of complementary mating electrical connectors.

Patent FR 2 450 510 discloses an embodiment, which makes possible the reduction of the peak of introduction caused by the insertion of the pin to the open end of the socket, in order to bring about the opening of its beams. Nevertheless, the invention described comprises the combination of a spindle-shaped part of the end of the pin and a decreasing thickness over a given length of the beam material. The first of these two characteristics is not currently applicable, because the design according to which spherical form is imposed on the end of the pin, does not comply with the requirements of international standards and has no effect on the rating function. The second characteristic is always used, because it makes possible an easy insertion to the end of the pin at the end of the socket beams, whose thickness falls due to the gradual machining of the inner surface of the beams in the direction of its open end. This second characteristic is therefore limited to facilitating the insertion of the pin, since the final contact of the pin in the socket takes place outside the thinned zone.

The solutions described in the said patents are nevertheless not completely satisfactory, either because they are not applicable to all dimensions of socket used in different areas of industry and are onerous in manufacture, or because they don't provide a solution to a potential risk involving exceeding the elastic limit of the material of the one-piece socket beams, or of the materials present at the point of contact.

There is accordingly a need for one-piece elastic socket contacts for electrical connectors, comprising variable inertia elastic beams making it possible to obtain over the length of every beam virtually identical stress, thus participating in the increase of deflection of every beam, in order to obtain a controlled force insertion of the pin contacts of a first connector into the elastic socket contacts of a complementary mating connector, and providing a large contact pressure when the connectors are mated.

For that purpose, the aspects of the disclosed embodiments propose a one-piece, controlled insertion force, elastic socket for electrical connectors, comprising a rear part in the form of a rod defining a first cylindrical zone and a tubular front part comprising a second perfectly rectilinear cylindrical zone extending the rear part open towards the front and divided by means of slots into elastic beams, a spindle-shaped end zone in which the thickness of the beams gradually decreases towards the open end of the tubular part, the said tubular part moreover comprising a cylindrical segment divided by means of slots into at least two elastic beams which has on its outer surface a cone frustum-shaped zone obtained by machining.

According to the disclosed embodiments, the cone frustum-shaped cylindrical segment is delimited by the connection zones of the said segment respectively with the second and the first cylindrical zones.

According to the disclosed embodiments the second cylindrical zone is an arm of the lever.

According to one of the principal characteristics of the disclosed embodiments, the cone frustum-shaped zone of the segment is a variable inertia element of elastic beams and works in deflection under quasi iso-stress.

According to one of the principal characteristics of the disclosed embodiments, the connection zone of the second cylindrical zone and of the cylindrical segment constitutes the final inertia variation zone of the elastic beams.

According to the disclosed embodiments, the element under quasi iso-stress participates in the increase of deflection of every elastic beam.

According to the disclosed embodiments the spindle-shaped end-zone decreases slowly in the direction of the open end of the beam.

According to the disclosed embodiments, the length of the second cylindrical zone makes it possible to participate in the adjustment of the multiplier coefficient of every beam.

The disclosed embodiments shall be better understood with the help of the description which follows and the appended drawings where FIG. 1 shows a section of two halves of connectors comprising respectively the male and female elements.

Figure 4A:
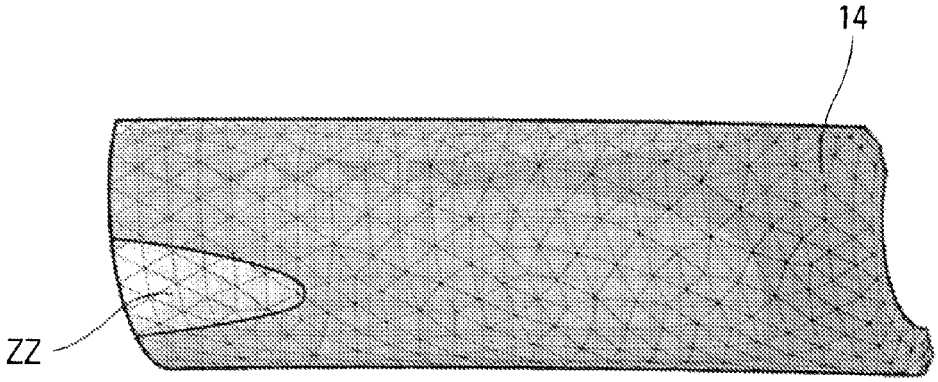
Figure 4B:
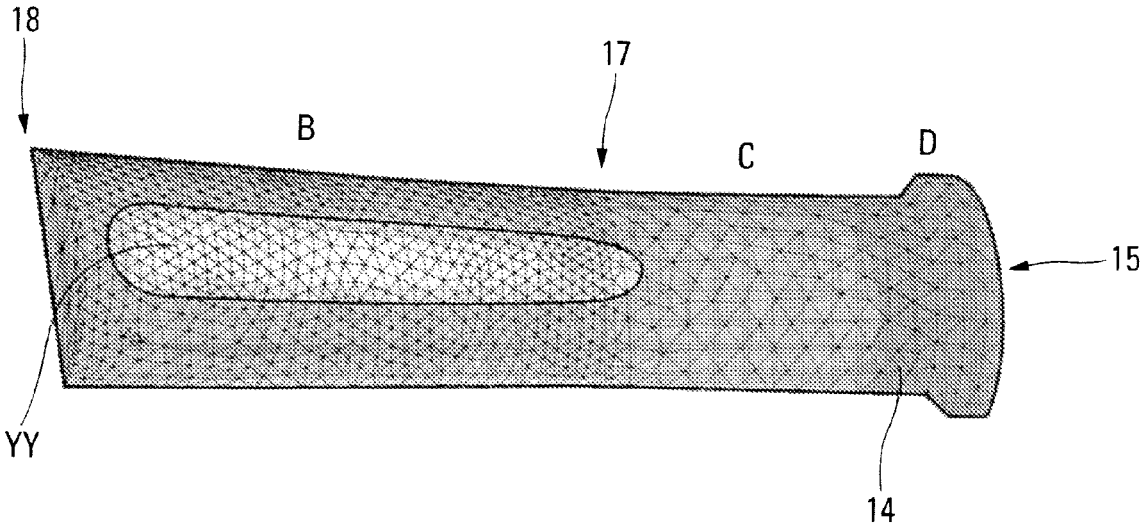
Figure 5A:
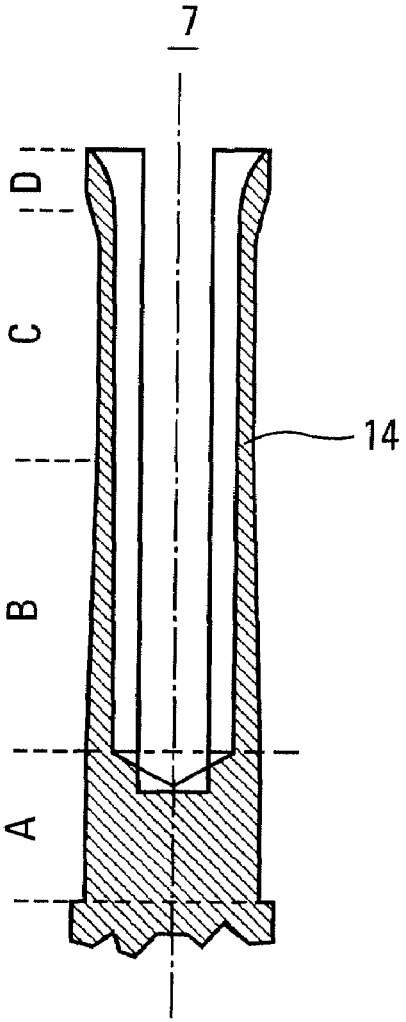
Figure 5A:
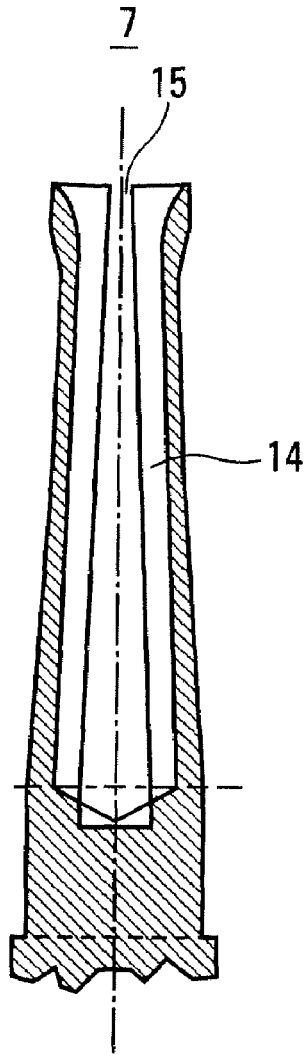
Figure 5A:
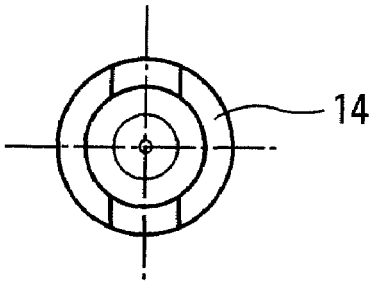
Figure 5B:
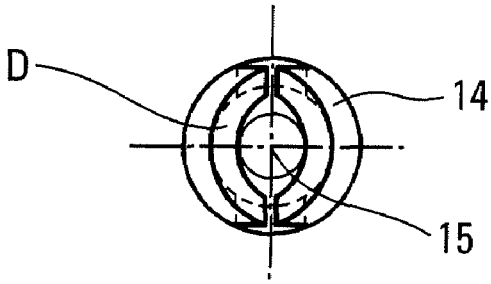

FIG. 4*a* and FIG. 4*b* show respectively a diagram of distribution of stress in a socket according to the prior art and a diagram of stress in a socket according to the disclosed embodiments, FIG. 5*a* and FIG. 5*b* show a section during the process of making of a socket according to the disclosed embodiments.

Figure 1:
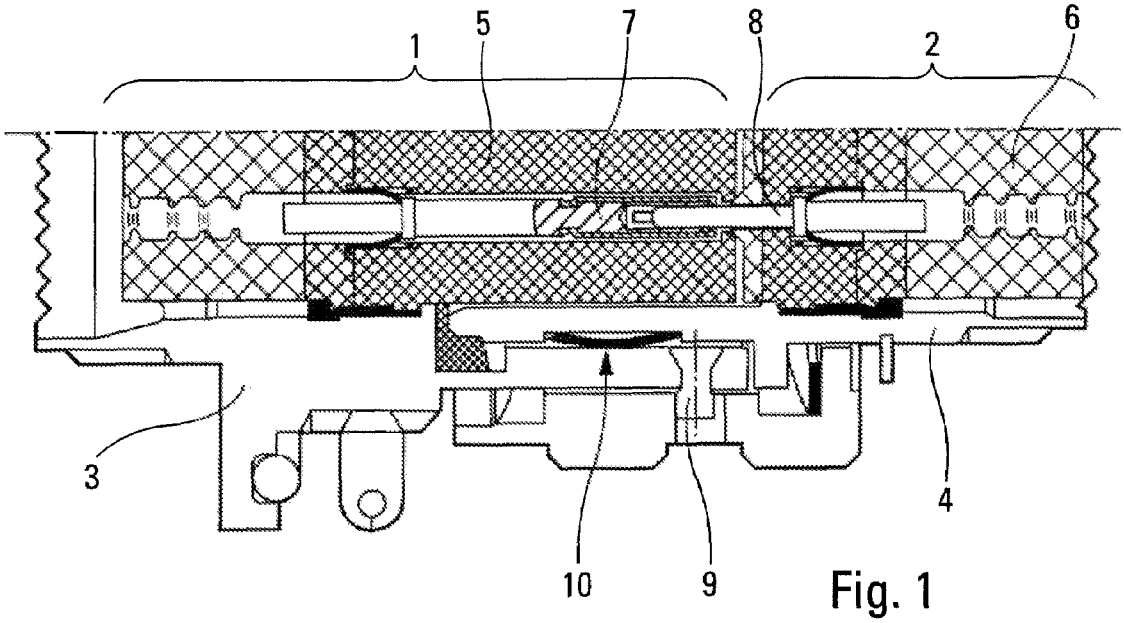

FIG. 1 show a section of an assembly of connectors 1 and 2 in mated and locked position, each of these connectors comprising a housing 3, 4, insulators 5, 6 comprising cavities in which are arranged the female elements or sockets 7 and male contacts or pins 8. Locking elements 9 and means of the earth connection 10 make possible the mechanical assembly of the connectors in a mated and locked position and the continuity of the earth connection between them.

It should be noted that the sockets and the pins are in an engaged position and that they comprise at the part opposite to their engaged part means of connection to electrical transmission wires, which are not shown.

Figure 2:
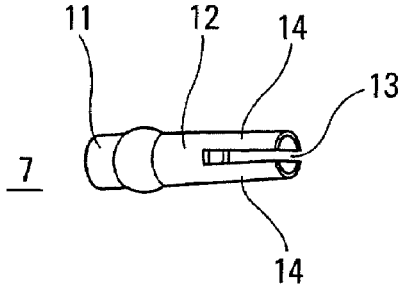
FIG. 2 shows a one-piece split socket according to the prior art.

FIG. 2 shows a side view of a one-piece split socket 7 according to the prior art in the form of a socket comprising a rear part 11 in the form of a rod, making possible the connection of electrical wires, a tubular part 12 extending the rear part 11 open in the forward direction and divided by means of slots 13 into elastic beams 14 intended during the process of moving away in radial fashion, to apply a contact pressure needed to ensure electrical continuity, to the pins 8 of the complementary mating connection connector 2, which can be seen in FIG. 1.

Figure 3:
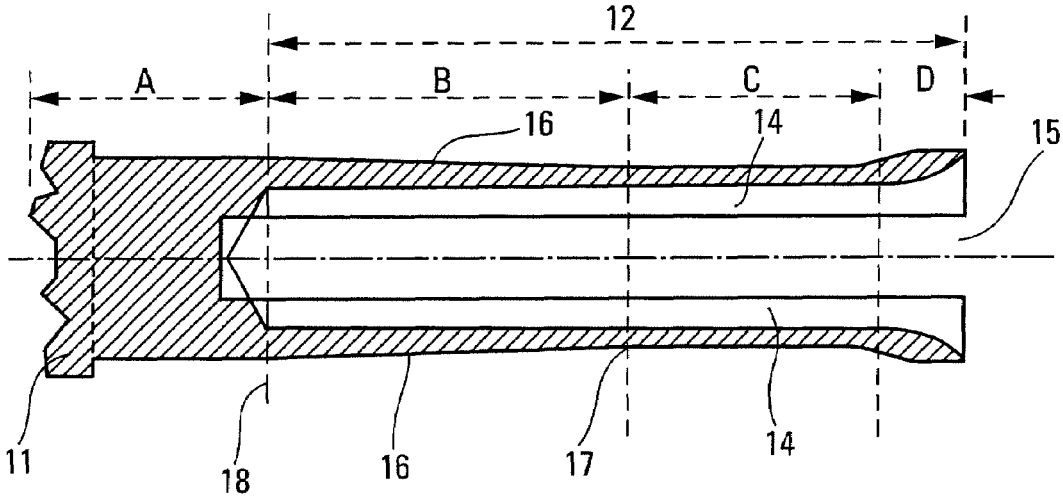
FIG. 3 shows an elastic socket according to the disclosed embodiments.

FIG. 3 shows a section of a socket 7 according to the invention. This socket comprises a rear part 11 in the form of a rod, which defines a first cylindrical zone A, a tubular part 12 open in a forward direction, which extends the rear part 11 and is divided by slots 13 which define two elastic beams 14. The tubular part 12 consists of a second cylindrical zone C, of a cylindrical segment B and of an end zone D close to the open end 15 in the form of a spindle-shaped on its inner face and whose thickness gradually decreases in the direction of the end of the open end 15.

For the sake of clarity of description, two each beams 14 and slots 13 are shown in the present figure, but the invention obviously also covers sockets with a larger number of beams and corresponding slots.

According to the invention, the outer surface 16 of the cylindrical segment B has the form of a cone frustum-shaped zone obtained by outside machining, whilst the outside machining of the second cylindrical zone C is completely rectilinear from the connection zone 17.

The second cylindrical zone C between the end zone D and the cone frustum-shaped cylindrical segment B is a lever arm, which makes it possible to increase and hence to participate in the adjustment of the multiplier coefficient of deflection of every beam 14.

As a non-limitative example, the outer diameter of the cone frustum-shaped cylindrical segment B in the connection zone 17 represents a value of ~8% a less than the value of the outer diameter of the cone frustum-shaped cylindrical segment B in the connection zone 18 with the cylindrical zone A.

It is clear, that this value quoted as an example of a socket is a function of the inner and outer diameters of the socket, as well as of the number and width of the beams and of the number of slots defining them.

The said cone frustum-shape machining makes it possible to obtain variable inertia over a length or the whole of the cone frustum-shaped cylindrical segment B, which constitutes a capital element of beam 14. The said inertia variation accordingly makes it possible to obtain a part of the beam, which works in deflection under quasi-identical stress over its entire length.

This distribution of stress can be seen clearly in FIGS. 4*a* and 4*b*, which show diagrams of analysis by finite elements method of beam 14 of a socket according to the prior art, with a zone ZZ in which is concentrated a maximum of stress close to the connection zone 18 with the cylindrical zone A. The stress which develop in beam 14 when pin 8 is inserted, often reach the elastic limit of the beam material.

On the other hand and according to the disclosed embodiments, FIG. 4*b* has a zone YY in which the stress are distributed quasi-identically in the cone frustum-shaped cylindrical segment B of beam 14.

FIG. 4*b* thus shows the stress formed in the cylindrical segment B between the connection zones 17 and 18 which constitutes a zone of inertia variation in the elastic beams 14.

It should be noted that in the cylindrical zone C which acts as a lever arm, the stress are distributed uniformly and that this zone cooperates with and extends the action of segment B.

This distribution of quasi-identical stress over the length of an elastic beam 14 makes possible an increase of its deflection due to the reduction of the effort needed and to a smaller variation of stress due to the size of the elements.

It should be noted that the length of the cylindrical zone C constituting the lever arm can also be lengthened and so make it possible to increase and to participate in the adjustment of the multiplier coefficient of the deflection of beam 14.

FIG. 5 show a socket 7 according to the disclosed embodiments following the operations of manufacturing consisting in machine-turning, the different diameters of cylindrical zones A, C, D and of the cone frustum-shaped cylindrical segment B and then in cutting the slots defining the beams 14, which can be seen in FIG. 5*a*.

Similarly, FIG. 5*b* shows the final positioning of beams 14 after the operation of retightening to bring the open end 15 to the size required by the geometry of the pins and the sockets to be assembled.

The use of a segment producing an inertia variation in a part or an element of a beam of an elastic socket contact of an electrical connector, makes it possible a remarkable improvement of the assembly-related characteristics of the sockets, permitting a medium force insertion (LIF), whilst retaining the intrinsic power transmission or signal characteristics due to the pressure exerted by the female contact beams of the elastic socket on the contact surface of the male pin.

As an example, the table below summarises the values of elastic sockets according to the prior art and the sockets (LIF) according to the disclosed embodiment.

| | Classical socket | Invention socket |
|---|---|---|
| Effort at beam end | 244 g | 91 g |
| Deflection | 0.08 mm | 0.144 |
| Average rating | 73 g | 27 g |
| Elastic limit | Reached | Not reached |

The disclosed embodiments are not limited to the foregoing or to the embodiments described earlier; on the contrary, it comprises all variants.

The invention claimed is:

1. A one-piece, controlled insertion force, elastic socket contact for electrical connectors comprising a rear part in the form of a rod defining a first cylindrical zone and a tubular front part comprising a second completely rectilinear cylindrical zone extending the rear part, open in the forward direction and divided by means of slots into elastic beams, a tapered spindle-shaped end zone in which the thickness of the beams gradually decreases in the direction of the open end of the tubular front part wherein the tubular part further comprises a cylindrical segment divided by means of slots into at least two elastic beams, said cylindrical segment having an outer surface with a cone frustum-shaped zone and wherein the cone frustum-shaped zone of said cylindrical segment comprises a variable moment of inertia element of the elastic beams for during the process of moving away in radial fashion, applying a large contact pressure needed to ensure electrical continuity to a pin contact of a first electrical connector into said one-piece elastic socket contact of a complementary electrical mating connector, said contact pressure being substantially uniform over the length of said cylindrical segment and thus said contact pin.

2. A one-piece, controlled insertion force, elastic socket contact according to claim 1 wherein the thickness of the spindle-shaped end zone gradually decreases in the direction of the open end of the beam.

3. A one-piece, controlled insertion force, elastic socket contact according to claim 1 wherein the length of the second cylindrical zone adjusts a multiplier coefficient of the deflection of every beam.

4. A one-piece, controlled insertion force, elastic socket contact according to claim 1 wherein said cone frustum-shaped zone is obtained by machining.

5. A one-piece, controlled insertion force, elastic socket contact according to claim 1 wherein the cone frustum-shaped cylindrical segment is delimited by connection zones of said segment with respectively the second cylindrical zone and with the first cylindrical zone.

6. A one-piece, controlled insertion force, elastic socket contact according to claim 5 wherein the second cylindrical zone located between one of said connection zones and the open end comprises a lever arm.

7. A one-piece, controlled insertion force, elastic socket contact according to claim 6 wherein one of the connection zones comprises an end of the zone of moment of inertia variation of the elastic beams.

8. A one-piece, controlled insertion force, elastic socket contact according to claim 1 wherein the element of the elastic socket works in deflection under nearly identical stress.

9. A one-piece, controlled insertion force, elastic socket contact according to claim 8 wherein the element under nearly identical stress participates in the increase of the deflection of every elastic beam.

* * * * *